United States Patent [19]

Sarley

[11] 4,026,415

[45] May 31, 1977

[54] PILFER-PROOF DISPLAY

[75] Inventor: John F. Sarley, Darien, Ill.

[73] Assignee: Litton Industrial Products, Inc., Berlin, Conn.

[22] Filed: June 17, 1976

[21] Appl. No.: 697,150

[52] U.S. Cl. ..... 211/4; 211/60 T

[51] Int. Cl.[2] ..... A47F 7/00

[58] Field of Search ..... 211/4, 60 T, 60 R, 57.1, 211/59.1, 54.1, 13; 248/DIG. 3

[56] References Cited

UNITED STATES PATENTS 3,084,802 4/1963 Ittner ..... 211/60 T

*Primary Examiner*—Roy D. Frazier
*Assistant Examiner*—Robert W. Gibson, Jr.
*Attorney, Agent, or Firm*—Spencer T. Smith

[57] ABSTRACT

A pilfer-proof display comprising a board including an area having a predetermined configuration, a plurality of object receiving posts secured to the board within this area with the free end of each post extending a selected distance from the board, a transparent substantially rigid cover member having an area substantially coextensive with the board area, at least one aperture in the transparent cover member proximate one edge thereof, a second aperture in the transparent cover member remote from the one edge, at least one supporting post secured to the board at a location selected to permit passage through the one aperture, the supporting post including at the free end thereof means for preventing the separation of the board and the cover member, proximate the supporting post, beyond the selected distance when the cover member and board are in parallel relation, the preventing means and the one aperture being selectively configured to permit rotation of the cover member about an axis parallel to the board, a closure post secured to the board at a location selected to permit passage through the second aperture, and the closure post including at the free end thereof locking means selectively displaceable from a first position, permitting the rotational displacement of the closure member, to a second position preventing the separation of the board and the cover member, proximate the closure post, beyond the selected distance.

4 Claims, 3 Drawing Figures

PILFER-PROOF DISPLAY

This invention relates to pilfer-proof merchandise displays.

Whenever merchandise is prominently displayed on a plurality of hangers which are supported on a pegboard or other type of panel, pilferage becomes a very real problem. Attempts have been made to pilfer-proof such displays. For example, selectively movable dogs have been secured to the free ends of the hangers to prevent the removal of merchandise from a hanger unless the associated dog has been displaced to a selected orientation (See U.S. Pat. No. 3,481,482).

Another approach which is disclosed in U.S. Pat. No. 3,850,300, is to simply prevent the unauthorized removal of the displayed merchandise with the utilization of a locking mechanism.

It is an object of the present invention to provide a merchandise display, wherein the visual impact of the merchandise is not deleteriously affected by the structure for inhibiting the theft of the merchandise.

It is another object of the present invention to provide a merchandise display, wherein the removal of merchandise is a noticeable event thereby inhibiting the theft thereof.

Other objects and advantages of the present invention will become apparent from the following portion of this specification and from the accompanying drawings which illustrate in accordance with the mandate of the patent statutes a presently preferred embodiment incorporating the principles of the invention. Referring to the drawings.

Figure 1:
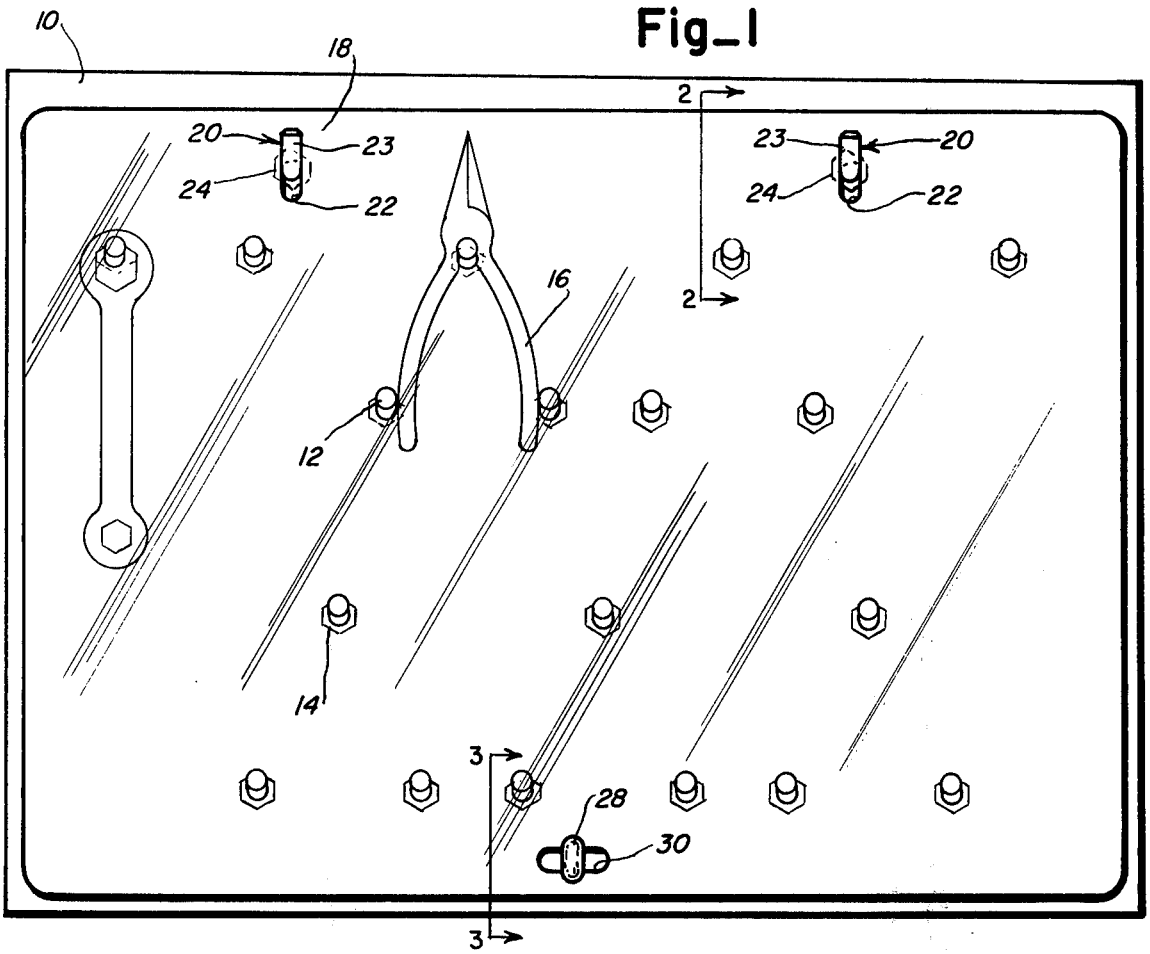
FIG. 1 is a front elevational view of a pilfer-proof display made in accordance with the teachings of the present invention.

The pilfer-proof display includes a board 10 to which a plurality of posts 12 are secured by means of locating nuts 14, which are threadedly received on the threaded end of the posts. These locating nuts are selectively adjusted so that all posts extend the same predetermined distance from the board. Merchandise such as hand tools 16 may be suitably supported by these posts.

The pilfer-proof display also includes a transparent substantially rigid cover member 18, which when placed in position covers all of the posts and lies in substantial engagement with the free end of each .

Figure 2:
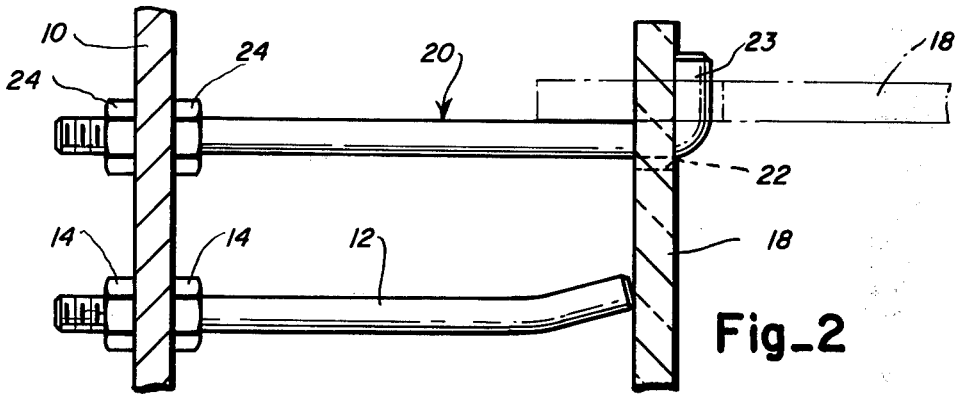
FIG. 2 is a view of the pilfer-proof display illustrated in FIG. 1 taken along the lines 2—2 thereof.
Figure 3:
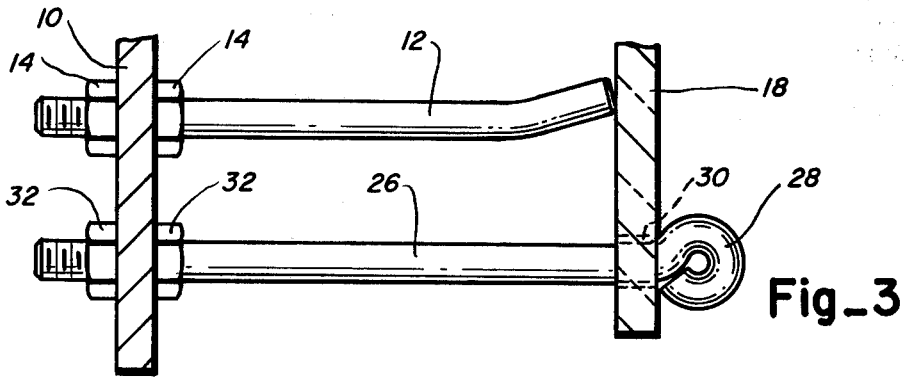
FIG. 3 is a view of the pilfer-proof display illustrated in FIG. 1 taken along the lines 3—3 thereof.

The cover member is supported in this position by a pair of pins 20 which are similarly secured to the board and which extend through a pair of suitable cover member apertures 22. The free ends of these pins are bent upwardly to permit rotational displacement of the cover member from the closed position illustrated in FIG. 1 to an open position illustrated in phantom in FIG. 2.

These bent portions 23 of the supporting pins are selectively located by suitably adjusting the location of locating nuts 24, so that the cover member, when in the closed position, will engage the free ends of the merchandise supporting posts.

A closure pin 26 including an eye portion 28, is similarly secured to the board and can pass through a suitable horizontally extending elongated board opening 30 when the eye portion is similarly oriented. Once the eye portion has passed through this opening , 90° rotation of the eye portion will forcefully urge the eye portion which is selectively located by suitably adjusting the location of locating nuts 32 into forceful engagement with the cover member thereby urging the cover member into engagement with the ends of the merchandise posts.

While the transparent cover member is in the closed position, it is extremely difficult to remove merchandise, since the cover member is substantially rigid and cannot be separated from the posts. Such rigidity will also result if the cover member apertures 22, 30 are located to prevent any substantial bowing of the cover member.

To remove merchandise, the eye portion 28 must be rotated 90° and the entire cover member rotated to an open position. This procedure is very noticeable whereby a sales person will be put on notice that merchandise is about to be removed from the display.

What is claimed is:

1. A pilfer-proof display comprising a board including an area having a predetermined configuration, a plurality of object receiving posts secured to said board within said area with the free end of each of said posts extending a selected distance from said board, a transparent cover member having an area substantially coextensive with said board area, at least one aperture in said transparent cover member proximate one edge thereof, a second aperture in said transparent cover member remote from said one edge, at least one supporting post secured to said board at a location selected to permit passage through said one aperture, said supporting post including at the free end thereof means for preventing the separation of said board and said cover member proximate said supporting post beyond said selected distance when said cover member and board are in parallel relation, said preventing means and said one aperture being selectively configured to permit rotation of said cover member about an axis parallel to said board, a closure post secured to said board at a location selected to permit passage through said second aperture, and said closure post including at the free end thereof locking means selectively displaceable from a first position permitting said rotational displacement of said closure member to a second position preventing the separation of said board and said cover member proximate said closure post beyond said selected distance .

2. A pilfer-proof display according to claim 1, further comprising means for selectively varing the axial position of said receiving, support and closure posts.

3. A pilfer-proof display according to claim 2, wherein said supporting post comprises a rod with the free end bent at a 90° angle.

4. A pilfer-proof display according to claim 3, wherein said closure post includes an eye portion at one end thereof.

* * * * *